United States Patent [19]

Niemeyer et al.

[11] 4,027,871

[45] June 7, 1977

[54] APPARATUS FOR APPLYING CONTACT PRESSURE TO PACKS OF TUBE SECTIONS

[75] Inventors: Willy Niemeyer, Natrup-Hagen; Helmut Simon, Lengerich, both of Germany

[73] Assignee: Windmoller & Holscher, Lengerich, Germany

[22] Filed: May 14, 1975

[21] Appl. No.: 577,479

Related U.S. Application Data

[63] Continuation-in-part of Ser. No. 469,897, May 14, 1974, abandoned.

[30] Foreign Application Priority Data

May 14, 1973 Germany ..... 2324361

[52] U.S. Cl. ..... 271/95; 271/99; 271/157; 271/160; 271/165

[51] Int. Cl.[2] ..... B65H 1/06; B65H 3/10

[58] Field of Search ..... 271/95, 165, 166, 157, 271/126, 101, 100, 99, 30 R, 160, 147, 35

[56] References Cited

UNITED STATES PATENTS 3,776,544 12/1973 Watson et al. ..... 271/157 X

FOREIGN PATENTS OR APPLICATIONS 2,003,087 7/1971 Germany ..... 271/95

420,214 3/1967 Switzerland ..... 271/95

*Primary Examiner*—Evon C. Blunk

*Assistant Examiner*—Bruce H. Stoner, Jr.

*Attorney, Agent, or Firm*—Fleit & Jacobson

[57] ABSTRACT

The apparatus is intended for use in conjunction with a rotary feeder having a stack magazine which contains packs of tube sections. The apparatus comprises pressure applying means acting on the tube sections, particularly in the form of laterally pivotally movable pressure-applying fingers, which bear on the uppermost pack of tube sections and are adapted to descend as the stack decreases in height. Actuating means are provided, which when the pressure-applying fingers have reached a position in which they are at a minimum distance from the suction rollers of the rotary feeder impart an outward pivotal movement to said pressure-applying fingers, raise them to an extent which corresponds to the height of the subsequently supplied pack or packs of tube sections, and cause the pressure-applying fingers to bear on said pack or packs. The pressure-applying fingers are removed from the stack in the plane of the tube sections upon which they press.

7 Claims, 1 Drawing Figure

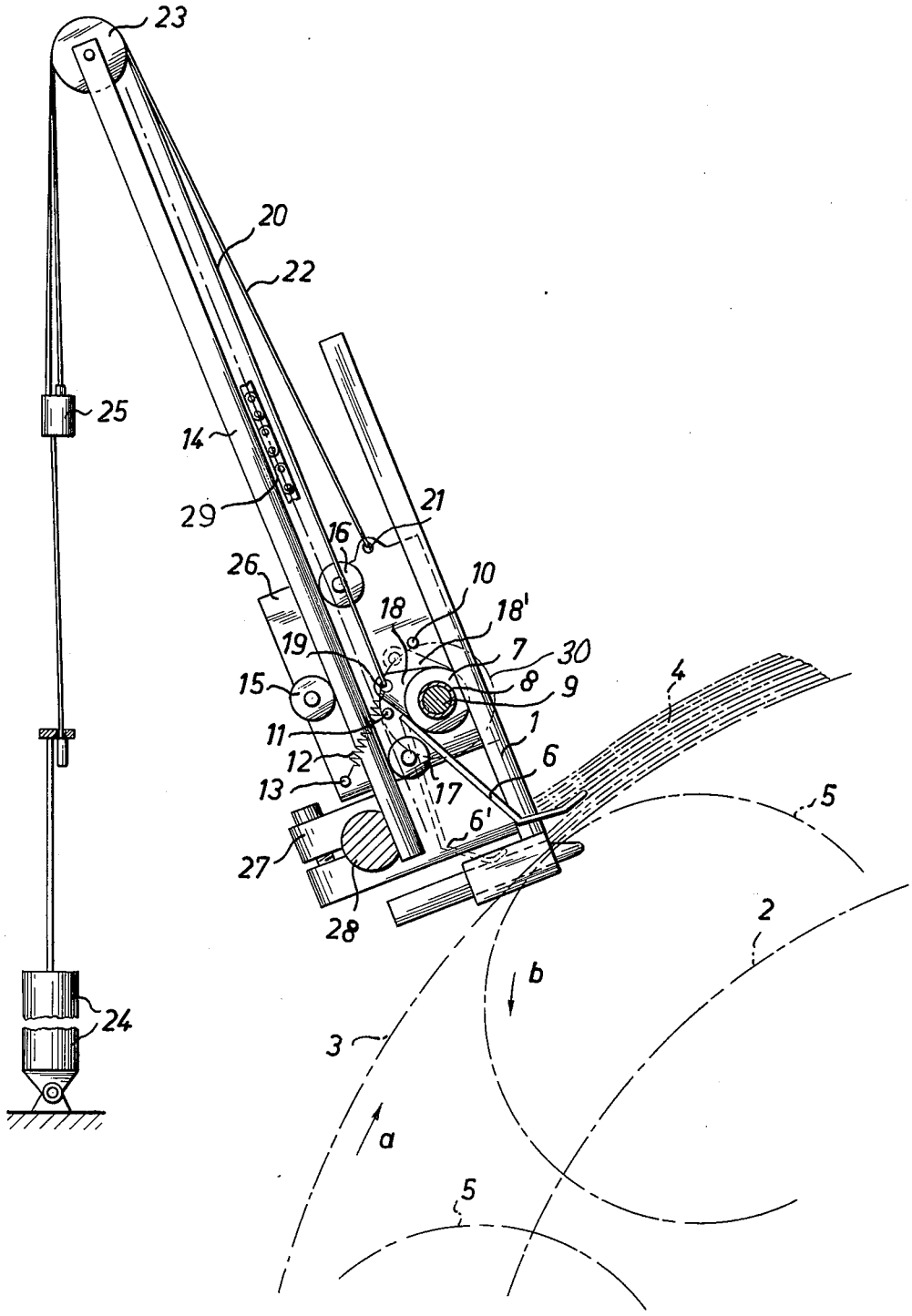
23
20
22
25
14
29
21
16
26
10
18
18'
19
7
30
15
8
9
4
11
1
12
6
13
17
5
6'
27
28
2
b
24
3
a
5

APPARATUS FOR APPLYING CONTACT PRESSURE TO PACKS OF TUBE SECTIONS

This application is a continuation in part of a copending application, Ser. No. 469,897, filed May 14, 1974 now abandoned.

This invention relates to an apparatus for applying contact pressure to stacks of tube sections held in the stack magazine of a rotary feeder, which apparatus comprises pressing means for applying pressure to the tube sections. The pressing means are lowerable as the height of the stack decreases, the device also comprising actuating means which displace the pressing means on reaching a certain spacing from the suction cylinders of the rotary applicator and which are moved to above the height of the packet of tube sections with which the magazine has been replenished, and are then lowered thereon.

Rotary feeders for singling tube sections which have been stacked are known, e.g., from the German Pat. Nos. 900,815 and 1,277,655. In these known rotary feeders, a stack of workpieces bears on rolling elements, which revolve in a cylindrical path around a common axis and have a common cylindrical envelope, and at least one of the rolling elements has a periphery which is longer than the width of the widest of the tube sections to be singled and rotates about its own axis in a direction which is opposite to the direction in which the rolling elements revolve around the common axis and is provided with suckers for sucking and taking along the lowermost tube section in the stack.

The tube section which has been withdrawn is transferred in a transfer station to a forwarding device, which is provided with grippers and forwards the tube section, e.g., to an end-laying machine. In the known apparatus, trouble may arise if the workpieces to be singled are not in sufficiently snug contact with the support formed by the revolving rolling elements so that the suction openings in the rolling elements do not sufficiently contact the lowermost workpiece. Because particularly with workpieces having a low flexibility the weight of the stacked workpieces is not sufficient alone to sufficiently force the leading edge thereof against the suction openings of the rolling elements, devices for ensuring a sufficient contact pressure have already been disclosed.

In an apparatus which is known from the Swiss Pat. No. 405,368, the leading edges of the stack of workpieces to be singled engage a conveyor belt, which by frictional engagement urges the workpiece edges against the suckers of the withdrawing rolling elements. A satisfactory operation of that known apparatus will be ensured only if the edges of the workpieces to be singled are in uniform contact with the friction belt. The rubbing on the workpiece edges may involve an undesired generation of heat and is particularly undesirable with workpieces of plastics material sheeting. Besides, the friction belt may dislodge individual workpieces in the stack so that they are withdrawn in an incorrect position.

German Pat. No. 851,897 discloses an apparatus in which a stack of paper tubes is pressed onto a support by a finger or stamp that is loaded by a weight. Pressing takes place at the end opposite to the withdrawing end and serves to prevent the withdrawing of more than one paper tube from the stack by the suckers. In this case, too, a new stack can be applied only when the pressing finger has been swung away entirely from the stack. This, however, generally takes place after only a few tube sections remain in the stack, so that the pressure is removed from the stack just when the latter is very light and there is a particular danger of withdrawing more than one section from the remnant of the stack by the suckers. Further, only stacks of small height can be applied because the upward motion achieved during pivotal movement is relatively small.

East German Pat. No. 45,735 relates to a rotary applicator apparatus which is to press the sheets to be withdrawn from a stack against the withdrawing suckers. For this purpose a lever system is rhythmically moved by way of a cam disc, which lever system cyclically swings a stack pusher into and out of the stack. During each swinging out movement of the stack pusher, its upper edge sweeps against the back of the immediately superposed sheets so that the latter, depending on the number of machine cycles, are more or less pressed out of their actual position and proper engagement of the sheets by the suckers is detrimentally influenced or made impossible. Another disadvantage resides in the nature of the drive for the pusher, which brings about unsettled movement, particularly because of the high cycle speeds that are nowadays usual with modern machinery.

The German Pat. No. 2,003,087 discloses an apparatus which comprises pressure-applying means, which are disposed above the stack magazine and can be moved up and down and are driven to be in their upper end position during the forward movement of means for supplying a new pack of tube sections and to lie on the rear portion of the supplied pack during or after the return movement of the supply device. In that known apparatus the pressure-applying means descend to a lower end position as the stack of tube sections contained in the stack magazine decreases in height, and they are then raised during the supply of a new pack and subsequently bear on the same. During the raising of the pressure-applying means at the very time at which the stack to be singled has only a small height so that it does not produce a contact pressure, the pressure-applying means also fail to apply contact pressure so that the withdrawal of the lowermost workpiece from the stack by the rolling elements provided with suckers is not ensured.

It is an object of the invention to provide a simple apparatus which ensures a trouble-free singling of the workpieces contained in the magazine also during a supply of new packs of workpieces.

According to the invention, this aim is fulfilled in an apparatus of the aforementioned kind in that the pressing means are substantially flat in the region of the stack and, before movement to above the stack height thereabove, are withdrawable from the stack substantially in the plane of the tube section on which they are pressing.

In an apparatus of the kind described first hereinbefore, this object is accomplished according to the invention by the provision of laterally pivotally movable pressure-applying fingers, which bear on the uppermost tube section of the stack and are adapted to descend as the stack decreases in height, and by the provision of actuating means, which when the pressure-applying fingers have reached a position in which they are at a minimum distance from the suction rollers of the rotary feeder impart an outward pivotal movement to said pressure-applying fingers substantially in the plane of the tube section on which they are pressing, raise them to an extent which corresponds to the height of the subsequently supplied pack or packs of tube section, and cause the pressure applying fingers to bear on said pack or packs. The apparatus according to the invention permits of a trouble-free singling of packs which have been inserted into the stack magazine automatically or by hand. To supply packs of tube sections to the stack magazine, the packs are placed in any desired number or height on the pressure-applying fingers. After a short sequence comprising an outward pivotal movement at right angles to the pressing force, a raising movement and an inward pivotal movement, the pressure-applying fingers bear again on the uppermost pack of tube sections so that there is always a contact pressure which ensures a trouble-free withdrawal of the workpieces to be singled. The shifting of the pressure-applying fingers takes place during a short interval of time, in which the stack of workpieces ensures an adequate contact pressure.

Preferably, the pressing means are formed by pressing fingers consisting of flanged levers of which the pivotal shaft is from the free flanged ends by a distance such that they can be withdrawn from the stack substantially at right-angles to the direction in which they press thereon.

The pressure-applying fingers are suitably secured to a pivoted shaft or a carrier, which is mounted in a carriage, which is adapted to be raised over the largest height of the stack to be formed by the packs of tube sections. The carriage which can be raised may be provided with rollers, which run on a guide rail. The outward pivotal movement of the pressure-applying fingers and their pressure-applying position are suitably limited by stops provided in the carriage. In a development of the invention, the pressing fingers can be swung out on reaching a minimum spacing from the suction cylinders of the rotary applicator. According to another feature of the invention, the pressure-applying fingers have a lever arm, which protrudes beyond their pivotal axis in the carriage, the means for lifting the carriage engage said lever arm at an end which is horizontally spaced from the pivotal axis, and a spring is provided, which urges the two-armed lever consisting of the lever arm and the pressure-applying fingers to its pressure-applying position. Because the means for raising the carriage engage a two-armed lever, one arm of which is formed by the pressure-applying fingers, these means swing out the pressure-applying fingers out of the stack magazine before the carriage is raised. When the carriage has been raised and subsequently lowered, a spring moves the pressure-applying fingers to their pressure-applying position in the stack magazine so that the fingers bear under the weight of the carriage on the stack of workpieces to be singled. A rope or cable which is operated by a pneumatic actuator is suitably provided to swing out the pressure-applying fingers and to raise the carriage.

A second rope is suitably provided, which engages the carriage and from which a counterweight can be suspended which serves to adjust different contact pressure forces. The weight of the carriage which loads the stacks of workpieces can then be reduced by the weight of the counterweight.

It will also be desirable to provide a limit switch, which initiates the raising of the carriage as soon as the pressure-applying fingers have reached their lower end position.

An embodiment of the invention will be explained more fully hereinafter by way of example with reference to the drawing, which is a diagrammatic side elevation showing the pressure-applying apparatus.

The rotary feeder is not shown in detail and substantially comprises a cage, which continuously rotates in the direction of the arrow *a* and in which a plurality of suction rollers 5 and backing rollers, not shown, are rotatably mounted with parallel axes on a circle 2, which is concentric with and centered on the axis of the cage. The suction rollers 5 are indicated by contour lines and are driven by gears, not shown, which are in mesh with a stationary gear ring, so that they rotate in the direction of the arrow *b* during the rotation of the cage. Reference is made to the Opened German Pat. No. 2,003,087 as regards the known design of the rotary feeder.

The stack magazine 1 extends radially of the cage and has no bottom. The pack 4 being singled rests on the suction rollers and backing rollers which move below the stack magazine and owing to its pliancy conforms to the flight circle 3 described by the outermost generatrices of the suction rollers and backing rollers during the rotation of the cage. The gear train imparts such a surface, or peripheral, velocity to the suction rollers that they roll on the undersurface of the pack 4. The suckers, not shown, are provided at the periphery of the suction roller with such an angular orientation that they contact the undersurface of the pack 4 at a point which closely succeeds the left-hand wall of the stack magazine in the direction of rotation *a* of the cage. The suckers suck the left-hand edge of the lowermost tube section into contact with the suction roller so that the tube section is wound on the periphery of said roller as the latter continues to roll. As a result, the tube section is removed from the stack magazine. By the suction roller, the tube section which has been removed is transferred to a gripper cylinder, not shown.

The stack magazine 1 may be supplied with packs 4 of tube sections by hand or automatically, as is required. The supplied packs 4 assume an inclined position, which is shown on the drawing and in which they deflect downwardly under their own weight.

Two spaced apart stationary guide rails 14 are provided, which extend parallel to the rear wall 1 of the stack magazine and along which the carriage 26 is guided by the rollers 15, 16, 17 as it is raised. A shaft 9 connects the side walls of the carriage 26 and is provided with a low-friction covering 8, on which is a hollow shaft 7 is rotatably mounted. The pressure-applying fingers 6 are welded to the hollow shaft 7 and have angled, or flanged, free end portions. In their extended position, shown on the drawing at 6, the pressure-applying fingers extend through slots in the grid-shaped rear wall of the magazine. The pressure-applying fingers are comblike. The hollow shaft 7 also carries at one end a leverlike extension 18, which is provided with a bore 19 for the attachment of the actuating rope 20. The leverlike extension 18 is arranged on the hollow shaft 7 with such an inclination that the extension forms an effective lever arm with respect to the axis of the hollow shaft, and tension applied to the actuating rope 20 will cause the pressure-applying fingers 6 to perform a pivotal movement to the position 6' indicated by dash-dot lines before the carriage 26 is raised. The angular movement of the hollow shaft is limited by stops 10, 11 which are disposed on both sides of the leverlike extension 18. When the pressure-applying fingers are in their outer position 6′, the leverlike extension lies on the stop 10, as is indicated by the dotted lines at 18′. The pressure-applying fingers 6 are held in their pressure-applying position by a spring 12, which is secured at one end to a pin 13 mounted on the carriage 26 and at the other end in the bore 19 in the extension 18. The tension of the spring 12 is only so large that when the rope 20 is operated the spring permits an outward pivotal movement of the pressure-applying fingers 6 before the carriage 26 is raised whereas the spring causes the pressure-applying fingers to swing into the stack magazine as soon as the actuating means have released the rope 20. The rope 20 extends around a freely rotatable deflecting roller 23 to a pneumatic actuator 24 and is actuated by the latter.

A second rope 22 is secured in the eyelet 21 of the carriage 26 and is also trained around a rope pulley and at its free end carries the counterweight 25. A separate reversing pulley is provided for the rope 22.

The guide rails 14 of the pressure-applying apparatus are mounted on a base 27, which is adjustable on and can be clamped to a stationary beam 28.

As soon as the pressure-applying fingers 6, which can descend with the carriage 26, have reached their lower end position and additional packs of tube sections have been placed into the stack magazine, a limit switch, not shown, causes a solenoid valve to initiate the operation of the actuator 24, which pulls on the rope 20 for a short time, thereby displacing the pressing fingers 6 from out of the stack magazine substantially at right-angles to the direction of pressing force, and moving the carriage 26 upwardly.

As soon as the carriage 26 has reached its upper end position the rope 20 is released by its actuating means and the pressure-applying fingers, which have been swung out by the spring 12, bear on the uppermost pack of tube sections in the stack magazine under the weight of the carriage 26, possibly reduced by the counterweight 25.

To prevent a canting of the carriage 26 on the guides 14 disposed on opposite sides, chains 29 are secured to said guides and in mesh with chain sprockets, which are indicated by dash-dot lines 30 and secured to a shaft which is rotatably mounted in the carriage 26. The chains may be replaced by racks and pinions in mesh therewith.

What is claimed is:

1. Apparatus for pressing downwardly packs of tube sections deposited and replenished in the stack magazine of a rotary feeder equipped with suction cylinders, comprising in combination:

carriage means arranged for reciprocal movement in said stack magazine and having a rotatable shaft means mounted thereon for pivotally mounting a plurality of pressing fingers having end portions for pressing engagement upon said tube sections and spring means connected to said carriage and said rotatable shaft means for biasing said fingers into a position for said pressing engagement, means for lowering said carriage means as the height of the stack of tube sections beneath said carriage decreases to maintain the downward pressing, and actuating means connected to said rotatable shaft means to pivot said fingers for lateral withdrawal from the stack of tube sections and to move concurrently said carriage means upwardly in said stack magazine when said carriage means reaches a predetermined spacing from the suction cylinders of the rotary feeder thereby placing said fingers in pressing engagement with the uppermost tube section in the replenished stack magazine.

2. Apparatus in accordance with claim 1 wherein said predetermined spacing between said carriage means and the rotary feeder suction cylinders is a minimum spacing between said carriage means and said suction cylinders.

3. Apparatus in accordance with claim 1 including guide rails on said stack magazine, a plurality of rollers on said carriage means for rolling engagement with said guide rails to guide said carriage means during said reciprocal movement.

4. Apparatus in accordance with claim 1 including a plurality of stops for limiting the pivotal movement of said pressing fingers in opposite directions.

5. Apparatus in accordance with claim 1 wherein said rotatable shaft means includes a radially extending lever arm mounted at one end on said shaft means for pivotal movement therewith and including means for connecting said actuating means and said spring means to the other end of said lever arm.

6. Apparatus in accordance with claim 1 wherein said actuating means includes a pneumatic actuator and a first rope for connecting said pneumatic actuator to said rotatable shaft means on said carriage means for moving said carriage means upwardly in said stack magazine.

7. Apparatus in accordance with claim 6 including a second rope connected at one end to said carriage means and a counterweight at the other end of said second rope for counterbalancing said carriage means.

* * * * *